US005607131A

United States Patent [19]

Adams

[11] Patent Number: 5,607,131

[45] Date of Patent: Mar. 4, 1997

[54] DOOR HOOK

[75] Inventor: William E. Adams, Portersville, Pa.

[73] Assignee: Adams Mfg. Corp., Portersville, Pa.

[21] Appl. No.: 493,647

[22] Filed: Jun. 22, 1995

Related U.S. Application Data

[60] Continuation-in-part of Ser. No. 429,231, Apr. 21, 1995, Pat. No. 5,535,971, which is a division of Ser. No. 182,738, Jan. 14, 1994, Pat. No. 5,413,297.

[51] Int. Cl.[6] ..... A47B 96/06

[52] U.S. Cl. ..... 248/215; 248/304; 248/914

[58] Field of Search ..... 248/215, 208, 248225.21, 227.1, 227.2, 217.1, 304, 301, 914, 205.3

[56] References Cited

U.S. PATENT DOCUMENTS

| | | | |
|---|---|---|---|
| D. 220,081 | 3/1971 | Trivilino | 8/239 |
| D. 252,088 | 1/1979 | Johansson | 14/3 |
| D. 267,604 | 1/1983 | Peabody et al. | 6/114 |
| D. 275,917 | 10/1984 | Einborn . | |
| D. 304,545 | 11/1989 | Hurrelbrink | 8/373 |
| D. 342,889 | 1/1994 | Adams | D8/367 |
| 514,222 | 2/1894 | Hall . | |
| 1,071,806 | 9/1913 | Schroyer et al. . | |
| 1,474,660 | 11/1923 | White . | |
| 1,501,807 | 7/1924 | Petschel . | |
| 1,902,241 | 3/1933 | Jones . | |
| 2,312,393 | 3/1943 | Donnelly | 240/128 |
| 2,346,276 | 4/1944 | Reittinger | 248/215 |
| 2,447,128 | 8/1948 | Logan | 248/290 |
| 2,506,119 | 5/1950 | Tregear | 248/200 |
| 2,516,617 | 7/1950 | Coughlin | 224/42.45 |
| 2,565,719 | 8/1951 | Church | 248/215 |
| 2,606,734 | 8/1952 | Magnuson | 248/215 |
| 2,631,803 | 3/1953 | Meyers | 248/215 |
| 2,738,188 | 3/1956 | Hoffman | 248/215 X |
| 2,743,023 | 4/1956 | Larson | 211/96 |
| 2,760,674 | 8/1956 | Karp | 220/55 |
| 2,954,954 | 10/1960 | Larson | 248/215 |
| 3,112,911 | 12/1963 | Cornwell | 248/215 |
| 3,536,287 | 10/1970 | Kramer | 248/301 |
| 3,630,475 | 12/1971 | Barry | 248/215 |
| 3,870,428 | 3/1975 | Jackson | 404/134 |
| 3,874,035 | 4/1975 | Schuplin | 24/84 |
| 3,891,176 | 6/1975 | Downing et al. | 248/340 |
| 3,918,670 | 11/1975 | Doherty | 248/214 |
| 4,247,070 | 1/1981 | Dirksing | 248/226.5 |
| 4,335,864 | 6/1982 | Merlini | 248/316 |
| 4,387,873 | 6/1983 | Pavlo et al. | 248/226.4 |
| 4,405,109 | 9/1983 | Murdoch | 248/215 |
| 4,767,092 | 8/1988 | Weatherly | 248/311.2 |
| 4,846,430 | 7/1989 | Ke | 248/215 |
| 4,856,744 | 8/1989 | Frankel | 248/215 |
| 4,880,133 | 11/1989 | Cullinane | 248/215 X |
| 4,893,773 | 1/1990 | Fujimoto | 248/311.2 |
| 4,979,712 | 12/1990 | Rios | 248/215 |
| 5,094,417 | 3/1992 | Creed | 248/215 |
| 5,149,051 | 9/1992 | Schriner | 248/205.3 X |
| 5,413,297 | 5/1995 | Adams | 248/215 |

FOREIGN PATENT DOCUMENTS

| | | | |
|---|---|---|---|
| 2275176 | 2/1960 | France | 355/248 |
| 804351 | 4/1951 | Germany | 248/215 |
| 1236 | 1/1892 | United Kingdom | 248/215 |
| 1278118 | 6/1972 | United Kingdom | 248/215 |

OTHER PUBLICATIONS

Product Sheet Titled Adams Invisibles™ Transparent Hooks And Holders.

Adams MFG. Detailer Retail Program Narrow Blister Suction Cups Dated Jul. 1, 1992.

*Primary Examiner*—Ramon O. Ramirez

*Attorney, Agent, or Firm*—Buchanan Ingersoll, P.C.; Lynn J. Alstadt

[57] ABSTRACT

An improved door hook or bracket which is thin enough to fit between the top of the door and the jamb, and strong enough to hold significant weight when the door is opened. The door hook is comprised of a U-shaped bracket which has a top having a bottom surface, a front side having a hook and a back side having an adhesive layer attached to the inside surface thereof. The front side is attached to one edge of the top at an acute angle relative to the bottom surface of the top. A compressible pad may be attached to the bottom surface of the top. The compressible pad preferably has a releasable adhesive. Flexible molded-in protrusions may be used as the compressible pad.

18 Claims, 2 Drawing Sheets

DOOR HOOK

RELATED APPLICATION

This is a continuation-in-part application of Ser. No. 08/429,231 which was filed on Apr. 21, 1995 now U.S. Pat. No. 5,535,971. That application is a divisional application from Ser. No. 08/182,738, filed Jan. 14, 1994, now U.S. Pat. No. 5,413,297.

BACKGROUND OF THE INVENTION

1. Field of the Invention

The present invention relates to improvements in an over-the-door hook.

2. Description of the Prior Art

Plastic door hooks in prior art are too thick to close a door safely without damaging a door. They have, in many cases, actually weakened the very hinges that hold the door, and also compressed and damaged both wood in the door and the jamb.

Door hooks which are thin enough to close a vast majority of doors safely have been developed. However, these door hooks will not hold objects of significant weights when the door is open. The door hooks are lifted and the objects fall to the ground.

SUMMARY OF THE INVENTION

An object of the present invention is to provide a door hook thin enough to fit between the top of the door and the jamb, and strong enough to hold any significant weight when the door is open.

The door hook of the present invention is comprised of a U-shaped bracket, having a top, a front side and a back side, an adhesive or adhesive pad on the inside surface of the back side, and a hook attached to the front side. The front side is angled inwardly toward the back side. The back side is also preferably angled inwardly toward the front side. Acute angles between the front side and the top and/or between the back side and the top increase holding power of the door hook.

A compressible pad which is about 0.020 to 0.030 inches thick may optionally be provided on the bottom surface of the top. The door hook with the adhesive will hold as much as three times more weight than it would hold without the adhesive. Use of the adhesive or adhesive pad on the back side of a hook provides nearly double the load carrying ability of a hook with a compressible pad having a releasable adhesive thereon placed on the top of the hook.

DETAILED DESCRIPTION OF THE INVENTION

Figure 1:
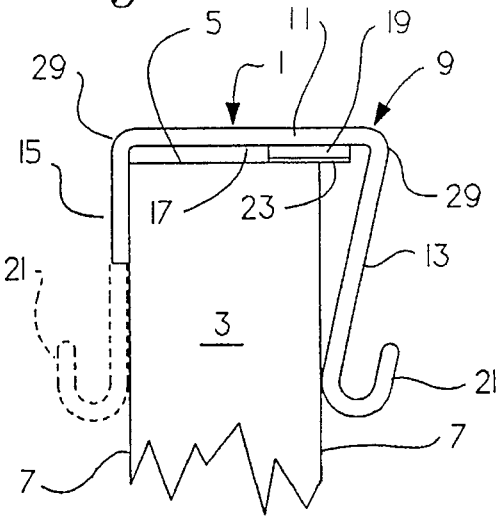
FIG. 1 is a side view of a door hook having an adhesive layer secured over a door.
Figure 2:
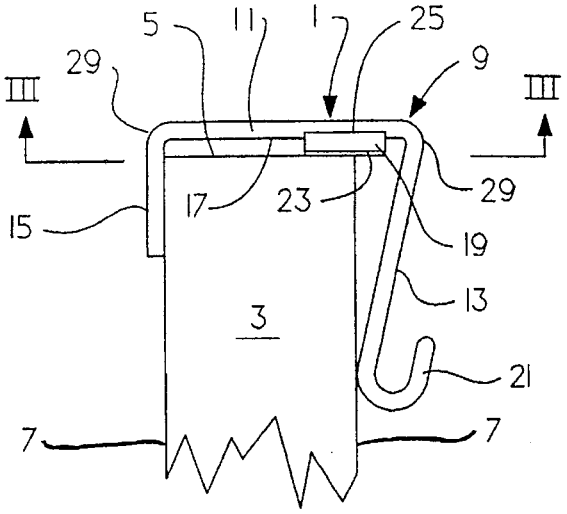
FIG. 2 is a side view of a second present preferred embodiment; of the door hook having an adhesive layer and a compressible pad secured over a door.
Figure 5:
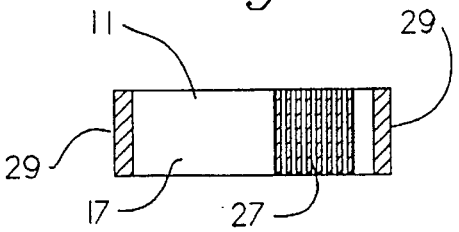
FIG. 5 is a cross-sectional view of the door hook of FIG. 4 along the line V—V.

As shown in FIGS. 1, 2 and 5, door hooks 1 of this invention are to be positioned over a door top 5 extending to both sides 7 of a door 3. In the first preferred embodiment shown in FIG. 1, the door hook 1 is comprised of a U-shaped bracket 9, adhesive layer 10 and hook 21. The U-shaped bracket 9 is comprised of a top 11 which has a bottom surface 17, a front side 13 and a back side 15. The adhesive layer is provided on the inside surface of the back side 15. Preferably, the layer is double faced adhesive tape. Double faced adhesive foam back tape may also be used. The front side 13 is attached to one edge 29 of the top 11 at an acute angle relative to the bottom surface 17. In the figures the size of that angle has been exaggerated so that the drawings are more easily understood. The back side 15 is attached to an edge 29 of the top 11 opposite to the front side 13. The hook 21 is attached to the front side 13. The back side 15 is preferably angled slightly inwardly toward the bottom surface 17 at an angle less than the front side 13 is angled inwardly toward the bottom surface 17. If desired, one could also attach a hook 21 to the back side 15. A notch 14 may be provided in one or both corners to give the door hook greater downward pull strength.

The bracket 9 is made of polypropylene, a polyolefin or polycarbonate. The top is preferably 0.050 to 0.070 inches thick to fit between a vast majority of door tops and jambs.

When an object is held on the hook 21, the front side 13 is pulled downward by the weight of the object. The downward force is likely to lift the back side 15 and the top 11 of the door hook 1. However, the adhesive layer 10 on the back side 15 and the acute angle between the front side 13 and the top 11 increases the holding power of the door hook 1 and helps to keep the door hook 1 from being lifted. The slight angle between the back side 15 and the top 11 also increases holding power of the door hook 1 marginally more.

Figure 3:
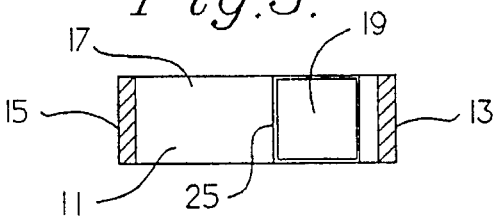
FIG. 3 is a cross-sectional view of the door hook of FIG. 2 along the line III—III.
Figure 7:
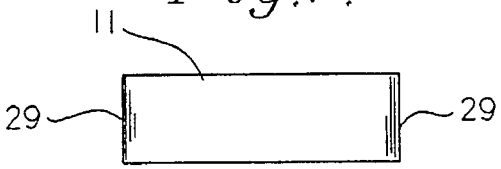
FIG. 7 is a top view of the door hook of the first present preferred embodiment and the second embodiment.
Figure 4:
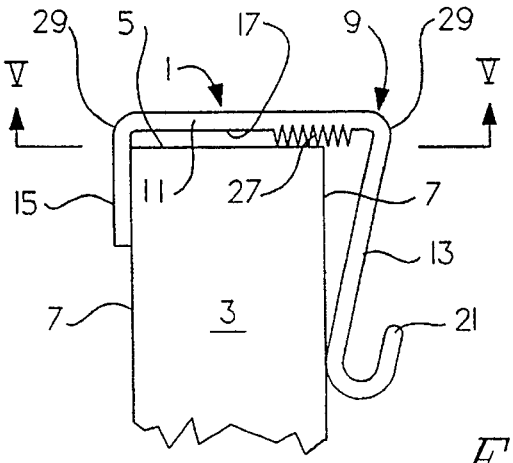
FIG. 4 is a side view of a third present preferred embodiment of a door hook secured over a door.

The second preferred embodiment shown in FIGS. 2, 3 and 4 is similar to the first embodiment. However, in this embodiment a compressible pad 19 is attached to the bottom surface 17 of the top 11. It is about 0.015 to 0.0425 inches thick. The compressible pad 19 is preferably positioned close to the front side 13. The compressible pad 19 can spread across the bottom surface 17 completely, but it is not necessary. The compressible pad 19 right next to the front side 13 provides the same holding power as it does spreading across all of the bottom surface 17.

The compressible pad 19 can be made of cardboard but most cardboard is too slippery. The best materials for making the compressible pad 19 are soft plastics, such as PVC or Telcar plastics, with low durometers under 90; rubber with the same low durometer; dense foam of similar thickness and hardness; and any thin, partly compressible material with a high frictional coefficient.

The compressible pad 19 preferably has a releasable adhesive 23 on a surface which abuts the door top 5. Adhesives such as those used for 3M Post-It notes can be used.

As shown in FIGS. 2 and 3, the door hook 1 preferably is molded with a ridge 25 in it to hold the compressible pad 19. Thus, the bottom surface 17 of the top 11 has a molded ridge 25 and the compressible pad 19 is attached to the ridge 25. If desired, the ridge can be omitted so that the pad is simply placed against the bottom surface 17 of top 11.

Figure 6:
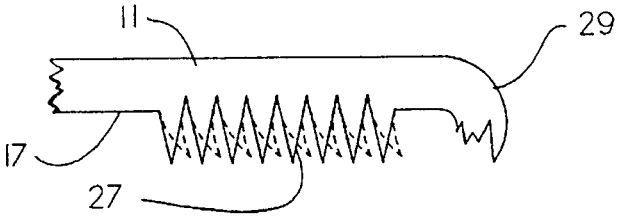
FIG. 6 is a side view of flexible protrusions of the door hook of FIG. 4.

FIGS. 4, 5 and 6 show a third present preferred embodiment of this invention. This door hook 1 is also comprised of a U-shaped bracket 9 having an adhesive layer 10 and a hook 21. Flexible protrusions 27 are provided on bottom surface 17. The U-shaped bracket 9 and the hook 21 have the same features as the first and second embodiments. The flexible protrusions 27 play the same role as the compressible pad 19 of the second embodiment.

Minor flexible protrusions 27 molded into a harder plastic may provide the same holding advantages as the compressible pad 19. These flexible protrusions 27 are 1/32 to 1/64 inches long and ¾ to 1 inches wide. These protrusions 27 could be molded, for instance, into a door hook 1 of a harder durometer PVC, and their thickness and compressibility would allow the door hook 1 to hold more weight. The door hook 1 with these flexible protrusions 27 or a compressible pad 25 will hold as much as 2 to 4 times more weight than it would hold without the protrusions or pad.

Two sets of hooks were tested. The first set of hooks was molded from polycarbonate resin and the second set of hooks was molded from "K-RESIN", a polyolefin material. The hooks were molded in the shape shown in FIGS. 1 and 2. First, one hook molded from each type of plastic and having no adhesive or compressible pad was placed over a door. A downward force was applied on each hook. That force was increased until the hook slipped from the door. The amount of force to cause the hook to slip was recorded. This procedure was repeated for a hook having a compressible polyurethane pad positioned as shown in FIGS. 2 and 3 with an adhesive on the pad, but no other adhesive applied. Finally, hooks of the type shown in FIG. 1 having 3M double sided adhesive foamed back tape on the inside surface of the back side were tested. The results of the tests are set forth in Table 1.

TABLE 1

FORCE REQUIRED TO PULL HOOK FROM DOOR

| HOOK TYPE | POLYCARBONATE | K-RESIN POLYOLEFIN |
|---|---|---|
| as molded | 23 lbs. | 16 lbs. |
| with pad on top | 28 lbs. | 20 lbs. |
| with adhesive on back | 47 lbs. | 46 lbs. |

As can be seen from Table 1, the hooks with adhesive on the inside surface of the back side held two to three times more weight than hooks without the adhesive.

Even though I have shown the present preferred embodiments mounted on a door, my device could also be used as a mounting bracket in other environments. Furthermore, the size of the top of the bracket should be selected to be slightly longer than the width of the door or other object on which the hook is placed.

Figure 8:
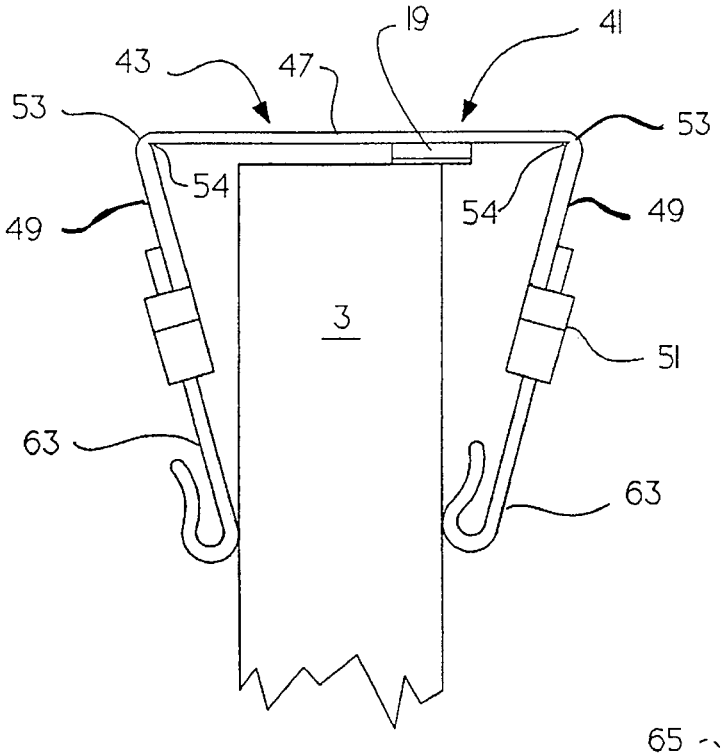
FIG. 8 is a side view of a fourth present preferred embodiment of a door hook secured over a door.
Figure 9:
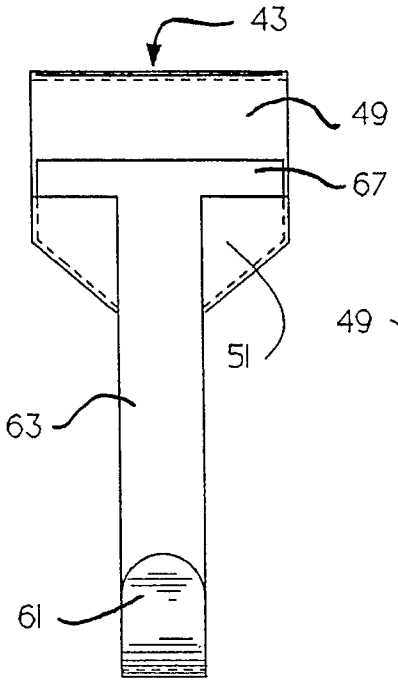
FIG. 9 is a front view of the embodiment of FIG. 8.
Figure 10:
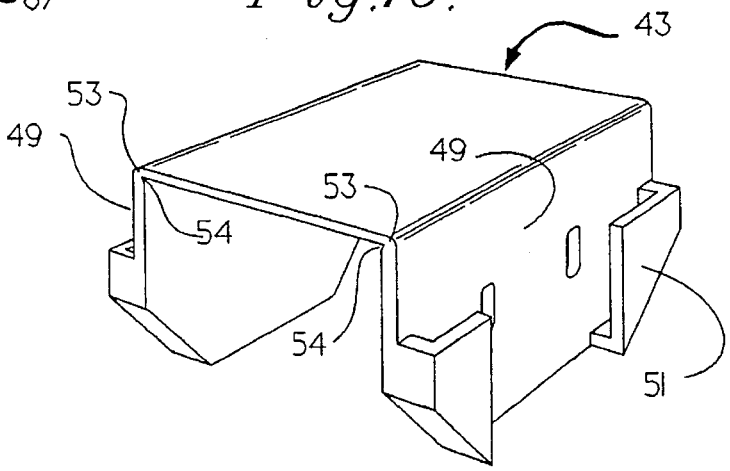
FIG. 10 is a perspective view of the bracket portion of the embodiment of FIG. 8.

FIGS. 8 through 11 show a fourth present preferred embodiment of this invention. As shown in FIGS. 8 and 9, a door hook 41 of the fourth preferred embodiment is comprised of a bracket 43 and a hook arm 45. As shown in FIG. 10, the bracket 43 is of a reverse U-shape and has a thinner and wider top portion 47 than the front and back side portions 49 and 50. An adhesive layer 52 is provided on the inside surface of back side 50. The top portion 47 is preferably about 0.06 inches thick. The front and back side portions 49 and 50 are preferably about 0.09 inches thick and 2 inches wide at angled corners 53 and narrowed at ends. The bracket 43 is clear and made of injection molded plastic to provide the angled corners 53 with strength to sustain the weight of hanging objects. A notch 54 may be provided in the angled corners 53 which gives the door hook 41 greater downward pull strength. The bracket 43 may extend across the top of the door 3. A compressible pad 19 is positioned between the top portion 47 of the bracket 43 and the top of the door 3.

The front side portion 49 has at least one locking nub 51 or fastening means to connect at least one hook arm 45 to the bracket 43. As shown in FIG. 9, the hook arm 45 is connected to the bracket 43 by being inserted into the locking nub 51. The locking nub 51 may be angled inward to match similar angles in the bracket 43 so that the hook arm 45 would not pull out.

Figure 11:
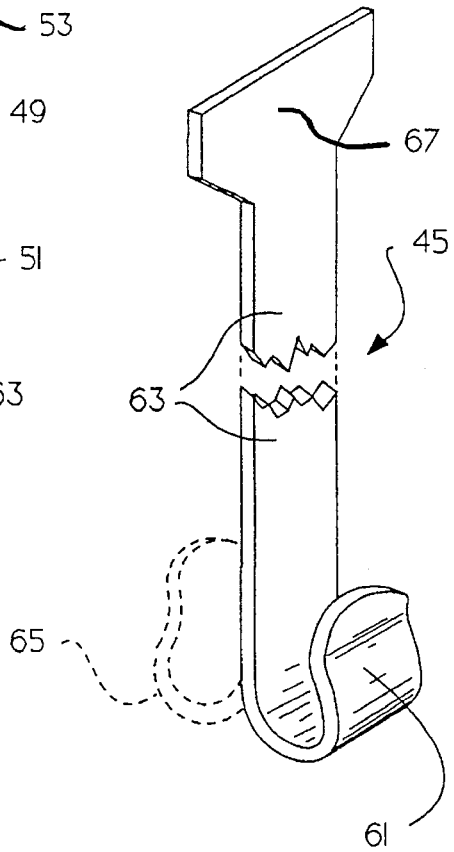
FIG. 11 is a perspective view of the hook portion of the embodiment of FIG. 8.

FIG. 11 shows a present preferred hook arm 45. The hook arm 45 is comprised of an arm portion 63 and a bottom hook portion 61. The hook arm 45 is preferably 11 inches long. Preferably, the arm portion 63 has an enlarged end 67 which is sized to fit into the locking nub 51 of the bracket 43. An object may be hung on the bottom hook portion 61 or an optional fixture 65 which extends out from the opposite side of the bottom hook portion 61.

Although I have described and illustrated certain present preferred embodiments of my door hook, it should be distinctly understood that my invention is not limited thereto, but may be variously embodied within the scope of the following claims.

I claim:

1. An improved mounting bracket to be extended over a door top to both sides of a door, comprising:

a) a U-shaped bracket having
   i) a top which has a bottom surface,
   ii) a front side which is attached to one edge of the top at an acute angle relative to the bottom surface of the top, and
   iii) a back side which is attached to an edge of the top opposite to the front side;

b) an adhesive layer applied to the back side on a surface facing the front side; and c) a hook attached to the front side.

2. The improved mounting bracket of claim 1 wherein the adhesive material is a strip of a double sided adhesive tape.

3. The improved mounting bracket of claim 2 wherein the double sided adhesive tape is a foam backed tape.

4. The improved mounting bracket of claim 1 wherein the top is about 0.050 to 0.070 inches thick.

5. The improved mounting bracket of claim 1 wherein the U-shaped bracket is made of one of polycarbonate, a polyolefin and polypropylene.

6. The improved mounting bracket of claim 1 also comprising a compressible pad attached to the bottom surface of the top.

7. The improved mounting bracket of claim 6 wherein the compressible pad is about 0.015 to 0.0425 inches thick.

8. The improved mounting bracket of claim 6 wherein the compressible pad has durometer under 90.

9. The improved mounting bracket of claim 8 wherein the compressible pad is made of materials selected from the group consisting of soft plastics, rubber and dense foam.

10. The improved mounting bracket of claim 8 wherein the compressible pad is made of any thin, partly compressible material with a high frictional coefficient.

11. The improved mounting bracket of claim 8 wherein the compressible pad has an adhesive on a surface which abuts the door top.

12. The improved mounting bracket of claim 11 wherein adhesive on the surface of the compressible pad which abuts the door top is releasable.

13. The improved mounting bracket of claim 8 wherein the bottom surface of the top has a molded ridge to which the compressible pad is attached.

14. The improved mounting bracket of claim 1 wherein the back side is angled inwardly toward the bottom surface of the top.

15. The improved mounting bracket of claim 1 also comprising a plurality of molded-in protrusions on the bottom surface of the top.

16. The improved mounting bracket of claim 15 wherein the protrusions are about 1/32 to 1/64 inches long and 3/4 to 1 inches wide.

17. The improved mounting bracket of claim 1 wherein a notch is provided between the bottom surface of the top and at least one of the front side and the back side.

18. The improved mounting bracket of claim 1 also comprising at least one locking hub attached to the front side of the U-shaped bracket, and the hook is comprised of an arm portion and a bottom hook portion, the arm portion being removably inserted into the at least one locking nub.

* * * * *

UNITED STATES PATENT AND TRADEMARK OFFICE

CERTIFICATE OF CORRECTION

PATENT NO. : 5,607,131

DATED : March 4, 1997

INVENTOR(S) : WILLIAM E. ADAMS

It is certified that error appears in the above-indentified patent and that said Letters Patent is hereby corrected as shown below:

Column 6, line 10, claim 18, change "hub" to --nub--.

Signed and Sealed this

Twenty-fourth Day of June, 1997

Bruce Lehman

*Attest:*

BRUCE LEHMAN

*Attesting Officer*

*Commissioner of Patents and Trademarks*